US009665062B2

(12) United States Patent
Akama et al.

(10) Patent No.: US 9,665,062 B2
(45) Date of Patent: May 30, 2017

(54) HOUSING STRUCTURE, ELECTRONIC APPARATUS, AND IMAGE FORMING APPARATUS

(71) Applicants: Shiro Akama, Tokyo (JP); Yuki Sato, Kanagawa (JP); Mami Akiyama, Kanagawa (JP); Yuta Ueda, Tokyo (JP); Hiroki Ishimitsu, Kanagawa (JP); Sakie Higuchi, Kanagawa (JP)

(72) Inventors: Shiro Akama, Tokyo (JP); Yuki Sato, Kanagawa (JP); Mami Akiyama, Kanagawa (JP); Yuta Ueda, Tokyo (JP); Hiroki Ishimitsu, Kanagawa (JP); Sakie Higuchi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/956,893

(22) Filed: Dec. 2, 2015

(65) Prior Publication Data

US 2016/0161903 A1 Jun. 9, 2016

(30) Foreign Application Priority Data

Dec. 8, 2014 (JP) ..... 2014-248104

(51) Int. Cl.

*G03G 21/16* (2006.01)
*G03G 21/20* (2006.01)
*G10K 11/16* (2006.01)

(52) U.S. Cl.

CPC ..... *G03G 21/1619* (2013.01); *G03G 21/1633* (2013.01); *G03G 21/206* (2013.01); *G03G 2215/0132* (2013.01); *G10K 11/161* (2013.01)

(58) Field of Classification Search

CPC ..... G03G 21/1619; G03G 21/1633; G03G 21/206

See application file for complete search history.

(56) References Cited

U.S. PATENT DOCUMENTS 8,540,557 B1 * 9/2013 Derks ..... F24F 13/24 454/184
9,253,556 B1 * 2/2016 Pounds ..... H04R 1/02
(Continued)

FOREIGN PATENT DOCUMENTS

JP 11-119138 4/1999
JP 2010-097036 4/2010

OTHER PUBLICATIONS

Machine translation of JP 2010-097036. Apr. 30, 2010.*

*Primary Examiner* — David Gray
*Assistant Examiner* — Carla Therrien
(74) *Attorney, Agent, or Firm* — Harness, Dickey & Pierce, P.L.C.

(57) ABSTRACT

A housing structure includes an exterior cover having an opening through which an interior of the exterior cover communicates with an exterior of the exterior cover, an interior cover disposed inside the exterior cover and facing the exterior cover with a clearance secured therebetween, an inward projection projecting from the exterior cover to the interior cover, and an outward projection projecting from the interior cover to the exterior cover. The inward projection and the outward projection define an airflow passage in the clearance between the exterior cover and the interior cover, and the airflow passage includes multiple bent portions. The outward projection is greater in width than the inward projection in an airflow direction toward the opening, and the airflow direction perpendicular to a direction in which the interior cover faces the exterior cover.

10 Claims, 12 Drawing Sheets

(56) References Cited

U.S. PATENT DOCUMENTS

| | | | | |
|---|---|---|---|---|
| 2002/0041362 | A1* | 4/2002 | Nakano | H04N 9/3141 353/31 |
| 2007/0059019 | A1* | 3/2007 | Kasama | G03G 15/6573 399/91 |
| 2011/0308037 | A1* | 12/2011 | Andersson | B01D 45/16 15/347 |
| 2014/0196329 | A1* | 7/2014 | Abadi | G09F 13/00 40/582 |
| 2015/0243274 | A1* | 8/2015 | Hirakawa | G10K 11/172 399/91 |
| 2015/0248880 | A1 | 9/2015 | Matsuda et al. | |
| 2016/0004216 | A1* | 1/2016 | Hatanaka | G03G 21/206 399/92 |
| 2016/0033928 | A1* | 2/2016 | Ishimitsu | G03G 21/1633 399/91 |
| 2016/0170368 | A1* | 6/2016 | Ishida | G03G 21/206 399/92 |

* cited by examiner

HOUSING STRUCTURE, ELECTRONIC APPARATUS, AND IMAGE FORMING APPARATUS

CROSS-REFERENCE TO RELATED APPLICATIONS

This patent application is based on and claims priority pursuant to 35 U.S.C. §119(a) to Japanese Patent Application No. 2014-248104, filed on Dec. 8, 2014, in the Japan Patent Office, the entire disclosure of which is hereby incorporated by reference herein.

BACKGROUND

Technical Field

Embodiments of the present invention generally relate to a housing structure, an electronic apparatus, and an image forming apparatus, such as a copier, a printer, a facsimile machine, or a multifunction peripheral having at least two of copying, printing, facsimile transmission, plotting, and scanning capabilities.

Description of the Related Art

In image forming apparatuses, heat is generated by various driving units when the image forming apparatus operates. There are image forming apparatuses that include an exterior cover having an opening to exhaust heated air from inside the apparatus.

SUMMARY

An embodiment of the present invention provides a housing structure that includes an exterior cover having an opening through which an interior of the exterior cover communicates with an exterior of the exterior cover, an interior cover disposed inside the exterior cover and facing the exterior cover with a clearance secured therebetween, an inward projection projecting from the exterior cover to the interior cover, and an outward projection projecting from the interior cover to the exterior cover. The inward projection and the outward projection define an airflow passage in the clearance between the exterior cover and the interior cover, and the airflow passage includes multiple bent portions. The outward projection is greater in width than the inward projection in an airflow direction toward the opening, and the airflow direction is perpendicular to a direction in which the interior cover faces the exterior cover.

In another embodiment, an electronic apparatus includes a sound source to generate sound, and the above-described housing structure to cover the sound source.

In yet another embodiment, an electrophotographic image forming apparatus includes a sound source to generate sound, and the above-described housing structure to cover the sound source.

BRIEF DESCRIPTION OF THE SEVERAL VIEWS OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION

Figure 1:
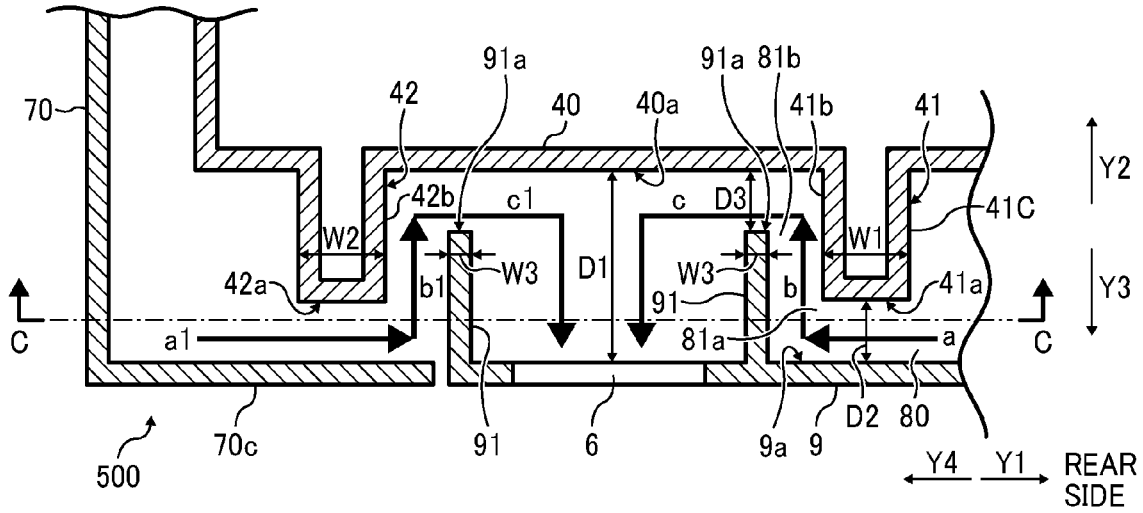
FIG. 1 is an enlarged horizontal cross-sectional view of a boundary between a front cover and a right-side cover of an image forming apparatus according to an embodiment, as viewed from above.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Figure 2:
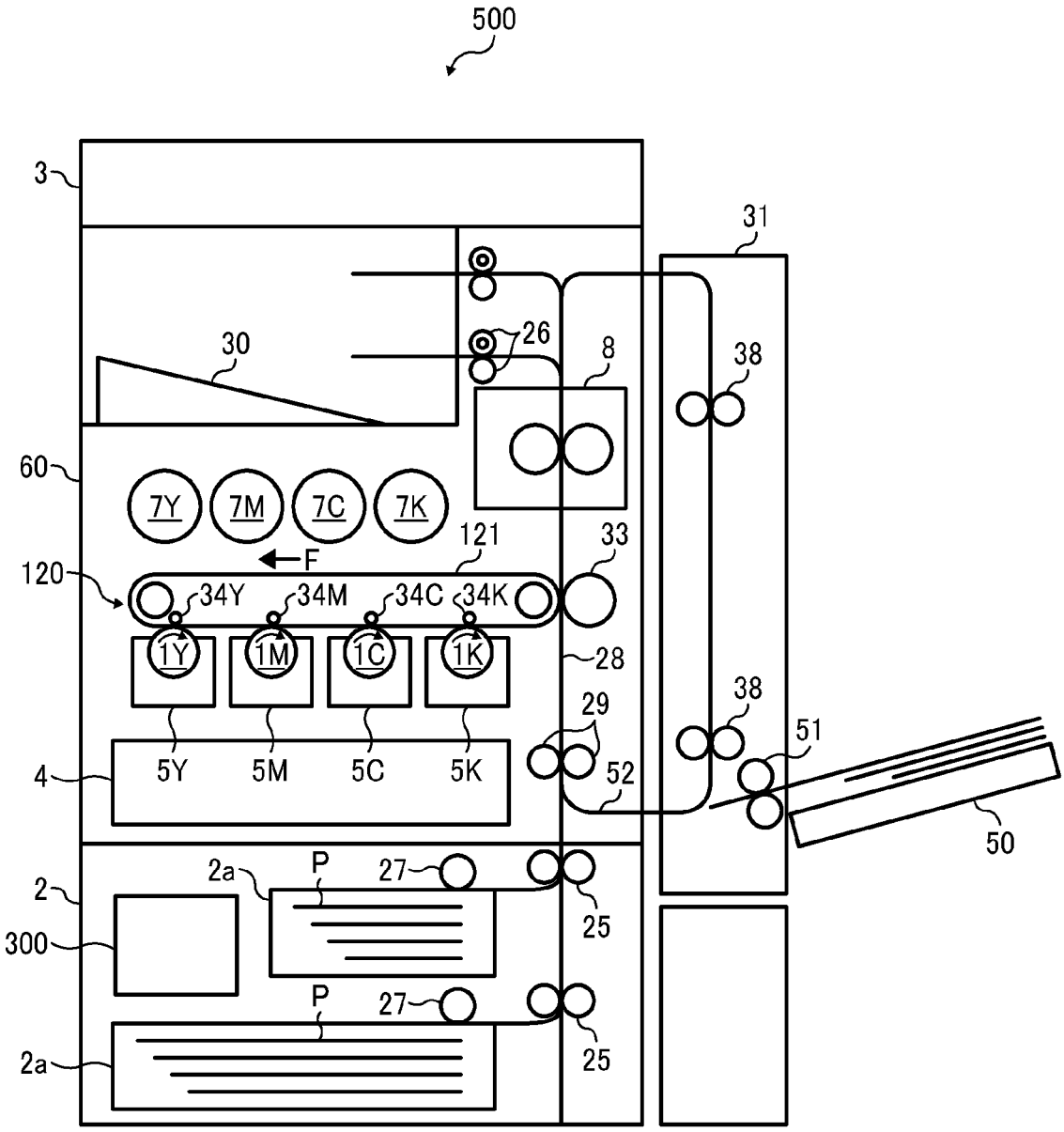
FIG. 2 is a schematic entire view of the image forming apparatus illustrated in FIG. 1.

Referring now to the drawings, wherein like reference numerals designate identical or corresponding parts throughout the several views thereof, and particularly to FIG. 2, an electrophotographic image forming apparatus according to an embodiment of the present invention is described.

Although a multicolor image forming apparatus 500 is described below as an example of the image forming apparatus according to the present embodiment, aspects of this specification can adapt to monochrome image forming apparatuses.

The image forming apparatus 500 illustrated in FIG. 2 is a multicolor image forming apparatus employing yellow (Y), magenta (M), cyan (C), and black (K) toners to form images. The image forming apparatus 500 includes an image forming unit 60, a sheet feeder 2, and a scanner 3 to read a document, according to which the image forming apparatus 500 forms an image. On the right side of the image forming unit 60 in FIG. 2, a sheet reversal unit 31 to turn a sheet upside down and transport the sheet is provided. The sheet reversal unit 31 includes conveyance rollers 38.

The image forming unit 60 includes four image forming stations 5Y, 5M, 5C, and 5K (also collectively "image forming stations 5") disposed along an intermediate transfer belt 121. The intermediate transfer belt 121 is entrained around multiple rollers in a loop and rotates in the direction indicated by arrow F in FIG. 2. Each of the image forming stations 5 includes a drum-shaped photoconductor 1 (1Y, 1M, 1C, and 1K) serving as an image bearer. The image forming unit 60 is provided with an exposure device 4.

Additionally, primary transfer rollers 34Y, 34C, 34M, and 34K (also collectively "primary transfer rollers 34") are provided inside the loop of the intermediate transfer belt 121 to transfer toner images from the photoconductors 1Y, 1C, 1M, and 1K, respectively, onto the intermediate transfer belt 121. Additionally, a secondary transfer roller 33 is disposed downstream from the primary transfer rollers 34 in the direction of rotation of the intermediate transfer belt 121 and facing an outer surface of the intermediate transfer belt 121. Additionally, a belt cleaning device is disposed downstream from the secondary transfer roller 33 in that direction to clean the surface of the intermediate transfer belt 121 after the toner image is transferred from the intermediate transfer belt 121.

It is to be noted that, in the image forming apparatus 500 according to the present embodiment, the intermediate transfer belt 121, the primary transfer rollers 34, the secondary transfer roller 33, and the belt cleaning device are united together as an intermediate transfer unit 120 removably installable to an apparatus body of the image forming apparatus 500. It is to be noted that the image forming stations 5, the exposure device 4, the intermediate transfer unit 120, a fixing device 8, and the like together function image forming means to form images on transfer sheets P (i.e., recording media) according to image data captured by the scanner 3.

The scanner 3 is positioned above the image forming unit 60 and includes a first carriage including a light source, a second carriage including mirrors, an imaging forming lens, and a reading sensor. The exposure device 4 is positioned below the image forming stations 5. The sheet feeder 2 is provided below the image forming unit 60. Specifically, the sheet feeder 2 includes sheet trays 2*a* to contain the transfer sheets P, sheet feeding rollers 27, and conveyance rollers 25. The fixing device 8 to fix the toner image on the transfer sheet P and an ejection roller pair 26 are disposed above the secondary transfer roller 33.

It is to be noted that image forming stations 5 are similar in configuration except the color of toner used therein, and the suffixes Y, M, C, and K are omitted in the drawings and specification when color discrimination is not necessary. In the image forming station 5, a charging device to charge the surface of the photoconductor 1 and a developing device to develop a latent image on the photoconductor 1 with toner into a toner image are disposed around the photoconductor 1. The image forming station 5 further includes a photoconductor cleaning device to clean the surface of the photoconductor 1 after transfer of the toner image therefrom.

Next, operation of the image forming apparatus 500 according to the present embodiment is described below.

When the image forming apparatus 500 receives a signal to start image formation, the intermediate transfer belt 121 starts rotating. Simultaneously, in the image forming station 5Y for forming yellow images, the charging device uniformly charges the surface of the photoconductor 1Y, and the exposure device 4 irradiates the photoconductor 1Y with laser light, thereby forming an electrostatic latent image thereon. Then, the developing device develops the electrostatic latent image, and thus a yellow toner image is formed on the photoconductor 1Y. Magenta, cyan, and black toner images are respectively formed on the photoconductors 1M, 1C, and 1K in the image forming stations 5M, 5C, and 5K similar to the image forming station 5Y.

As the intermediate transfer belt 121 rotates, the respective toner images are sequentially transferred from the photoconductors 1 and superimposed one on another on the intermediate transfer belt 121, thus forming a multicolor toner image (e.g., a composite color image). It is to be noted that, image formation is executed sequentially in the image forming stations 5 from the upstream side to the downstream side in the direction of rotation of the intermediate transfer belt 121 at different timings so that the respective color toner images are transferred to an identical position on the intermediate transfer belt 121.

Meanwhile, the sheet feeding roller 27 picks up the transfer sheet P from the sheet tray 2*a*, and the conveyance roller 25 feeds the transfer sheet P to a secondary transfer nip, where the secondary transfer roller 33 is pressed against the intermediate transfer belt 121. The secondary transfer roller 33 transfers the composite color image from the intermediate transfer belt 121 onto the transfer sheet P. After the image is transferred thereto, the transfer sheet P is transported to the fixing device 8, and image is fixed thereon. Subsequently, the transfer sheet P is either ejected from the apparatus and stacked on an output tray 30 by the ejection roller pair 26 or forwarded to the sheet reversal unit 31 to form an image on a back side of the transfer sheet P.

Subsequently, the photoconductor cleaning device removes toner remaining on the surface of the photoconductor 1. Similarly, the belt cleaning device removes toner remaining on the intermediate transfer belt 121 after the toner image is transferred therefrom. The toner (i.e., waste toner) thus removed from the photoconductor 1 is discharged by a waste-toner conveying screw of the photoconductor cleaning device to a waste-toner bottle 300 disposed inside the image forming apparatus 500. Similarly, the toner removed from the intermediate transfer belt 121 is discharged by a waste-toner conveying screw of the belt cleaning device to the waste-toner bottle 300 in the image forming apparatus 500.

Toner contained in the developing device is consumed in image formation, and toner is supplied to the respective developing devices through toner conveyor paths as required from toner bottles 7 (7Y, 7M, 7C, and 7K) containing yellow, magenta, cyan, and black toners, respectively, disposed in an upper left portion of the image forming apparatus 500 in FIG. 2. It is to be noted that the arrangement order of the four image forming stations 5Y, 5M, 5C, and 5K and the toner bottles 7Y, 7M, 7C, and 7K is not limited to the order illustrated in FIG. 2.

To make a copy of a document, for example, a user places the document (i.e., a sheet) on a document table of the scanner 3. Then, the user presses a copy start switch, and the scanner 3 starts reading the image data of the document. In reading the image data, the first and second carriages start moving, and the first carriage directs an optical beam from the light source onto the document. Subsequently, the optical beam reflected from the surface of the document is reflected by the mirror of the second carriage, passes through the imaging lens, and then enters the reading sensor. Thus, the reading sensor obtains the image data of the document.

In parallel to reading of image data, components of the image forming stations 5, the intermediate transfer unit 120, the secondary transfer roller 33, and the fixing device 8 start operating. According to the image data obtained by the scanner 3, the exposure device 4 is driven, and yellow, magenta, cyan, and black toner images are formed on the photoconductors 1Y, 1M, 1C, and 1K, respectively. These toner images are superimposed on the intermediate transfer belt 121 into a four-color toner image.

Additionally, almost simultaneously with the start of image data reading, the sheet feeder 2 starts sheet feeding. Specifically, one of the sheet feeding rollers 27 is selectively rotated, and the transfer sheets P are fed from the corresponding one of the sheet trays 2*a* stacked one on another. The sheet feeding roller 27 separates the transfer sheets P one by one by and feeds the transfer sheet P to a sheet feed path 28, after which a conveyance roller pair 29 transports the transfer sheet P to the secondary transfer nip. Instead of sheet feeding from the sheet trays 2*a*, the transfer sheets P may be fed from a side tray 50 projecting from the side of the apparatus. In this case, a sheet feeding roller 51 is rotated to feed the transfer sheets P from the side tray 50 one by one to a multi-purpose path 52.

Figure 3:
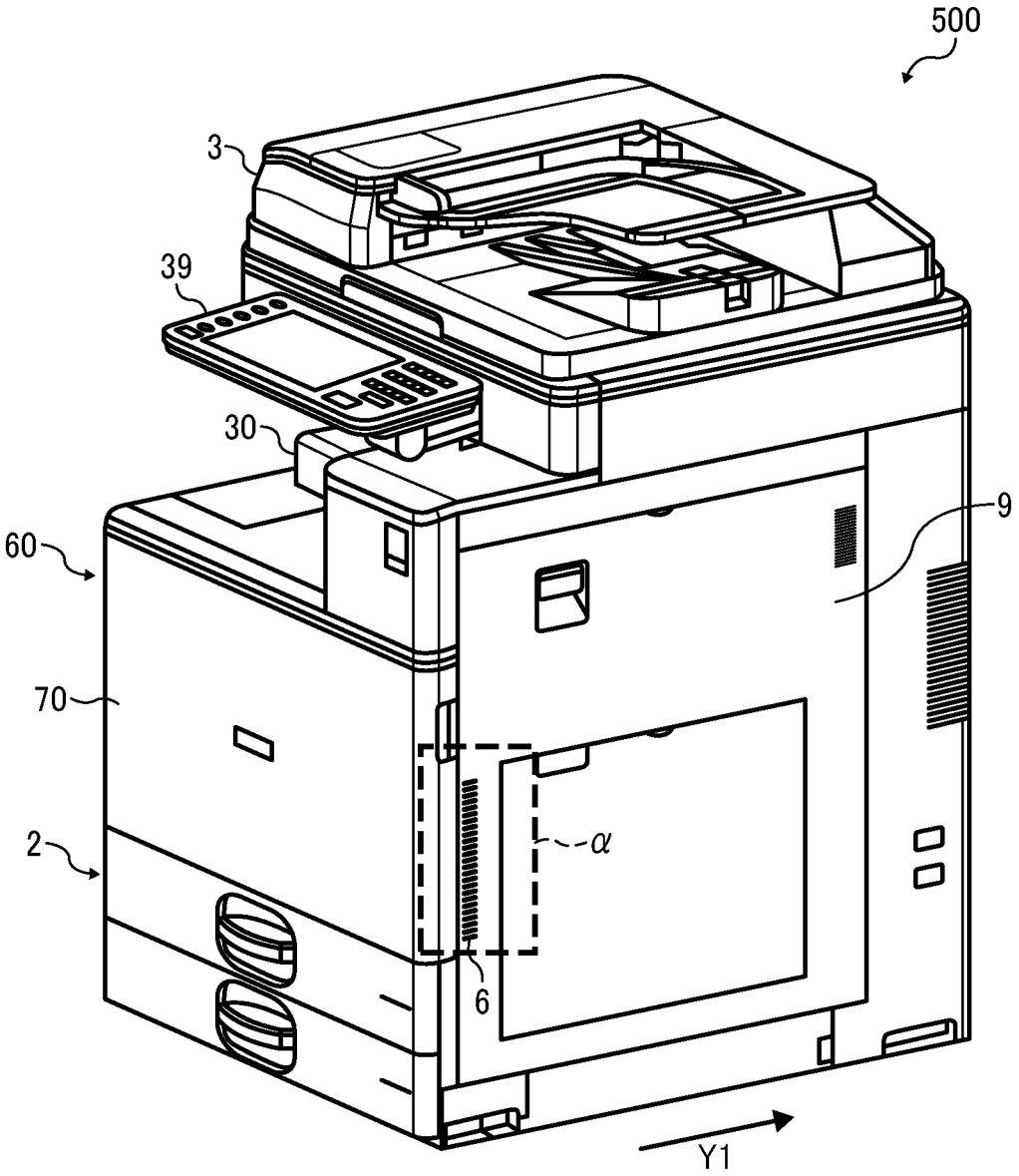
FIG. 3 is a perspective view that illustrates an exterior of the image forming apparatus illustrated in FIG. 2.

FIG. 3 is a perspective view that illustrates an exterior of the image forming apparatus 500.

In FIG. 3, arrow Y1 indicates backward direction from a front side of the image forming apparatus 500, on which the control panel 39 is disposed, to a rear side. As illustrated in FIG. 3, the image forming apparatus 500 includes a front cover 70 and a right-side cover 9. Each of the front cover 70 and the right-side cover 9 is pivotable around a shaft disposed at a lower end thereof and thus openably closable to the apparatus body.

Figure 4:
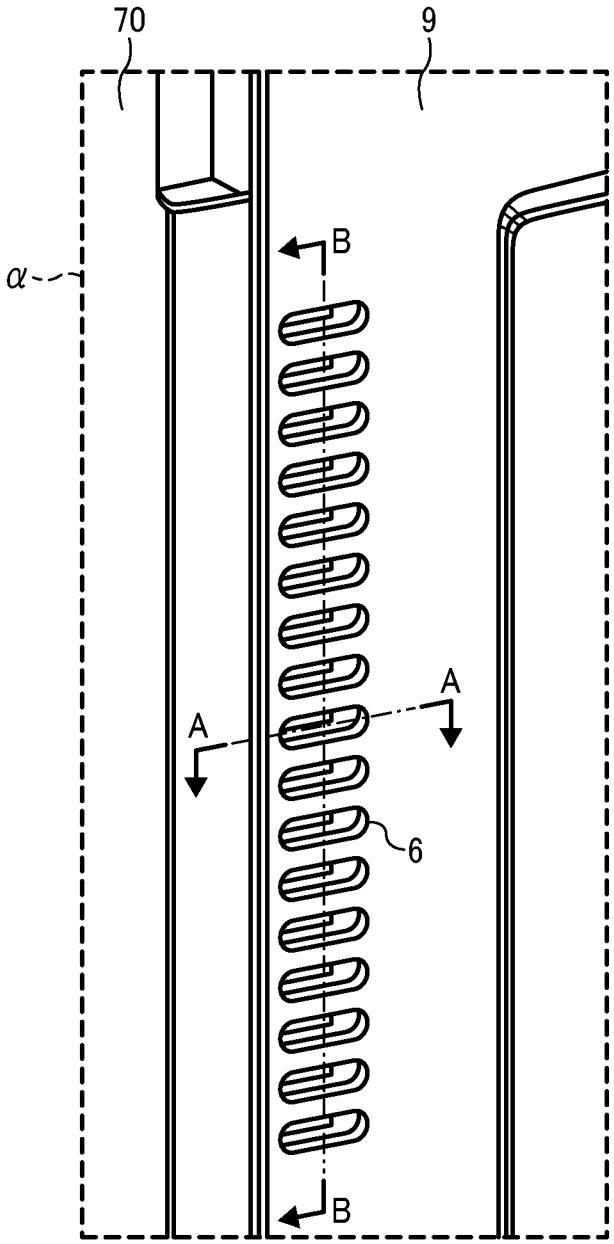
FIG. 4 is an enlarged perspective view of an area of the image forming apparatus illustrated in FIG. 3.

FIG. 4 is an enlarged perspective view of an area α in FIG. 3.

As illustrated in FIGS. 3 and 4, the right-side cover 9 includes multiple openings (hereinafter "side cover openings 6") through which an interior of the apparatus body (inside the right-side cover 9) communicates with the outside of the apparatus. That is, the side cover openings 6 are through holes in the right-side cover 9. Although there are the multiple side cover openings 6 in the configuration illustrated in FIGS. 3 and 4, alternatively, the right-side cover 9 includes a single opening in another embodiment.

When the image forming apparatus 500 is driven, various driving elements therein generate heat. Through the side cover openings 6, external air is supplied from outside the image forming apparatus 500 to the interior thereof, and heat is transmitted from inside to the outside of the image apparatus 500. Thus, when the image forming apparatus 500 is driven, temperature rise inside the image forming apparatus 500 is inhibited.

When the image forming apparatus 500 is driven, the various driving elements therein generate noise in addition to heat and thus serve as sound sources as well. The front cover 70 and the right-side cover 9 together serve as an exterior cover (or a housing) to partition the interior of the image forming apparatus 500 from the outside thereof. The exterior cover inhibits transmission of sound generated in the image forming apparatus 500 to the outside, thereby suppressing the occurrence of noise. The side cover openings 6, however, allow the interior of the exterior cover to communicate with the outside, enabling air to enter and exit the exterior cover. Accordingly, it is possible that the side cover openings 6 allow the sound to leak outside the image forming apparatus 500, and people around the apparatus receive the leaking sound as noise and feel uncomfortable.

Additionally, the user of the image forming apparatus 500 operates (or inputs instructions to) the image forming apparatus 500 on the front side of the image forming apparatus 500, on which the control panel 39 is disposed. Accordingly, in an arrangement in which the side cover openings 6 are close to the front side of the image forming apparatus 500, the sound leaking through the side cover openings 6 easily reaches the user, and it is possible that the user feels uncomfortable with the sound.

Descriptions are given below of an example of the sound sources of the sound leaking from the side cover openings 6.

Figure 5:
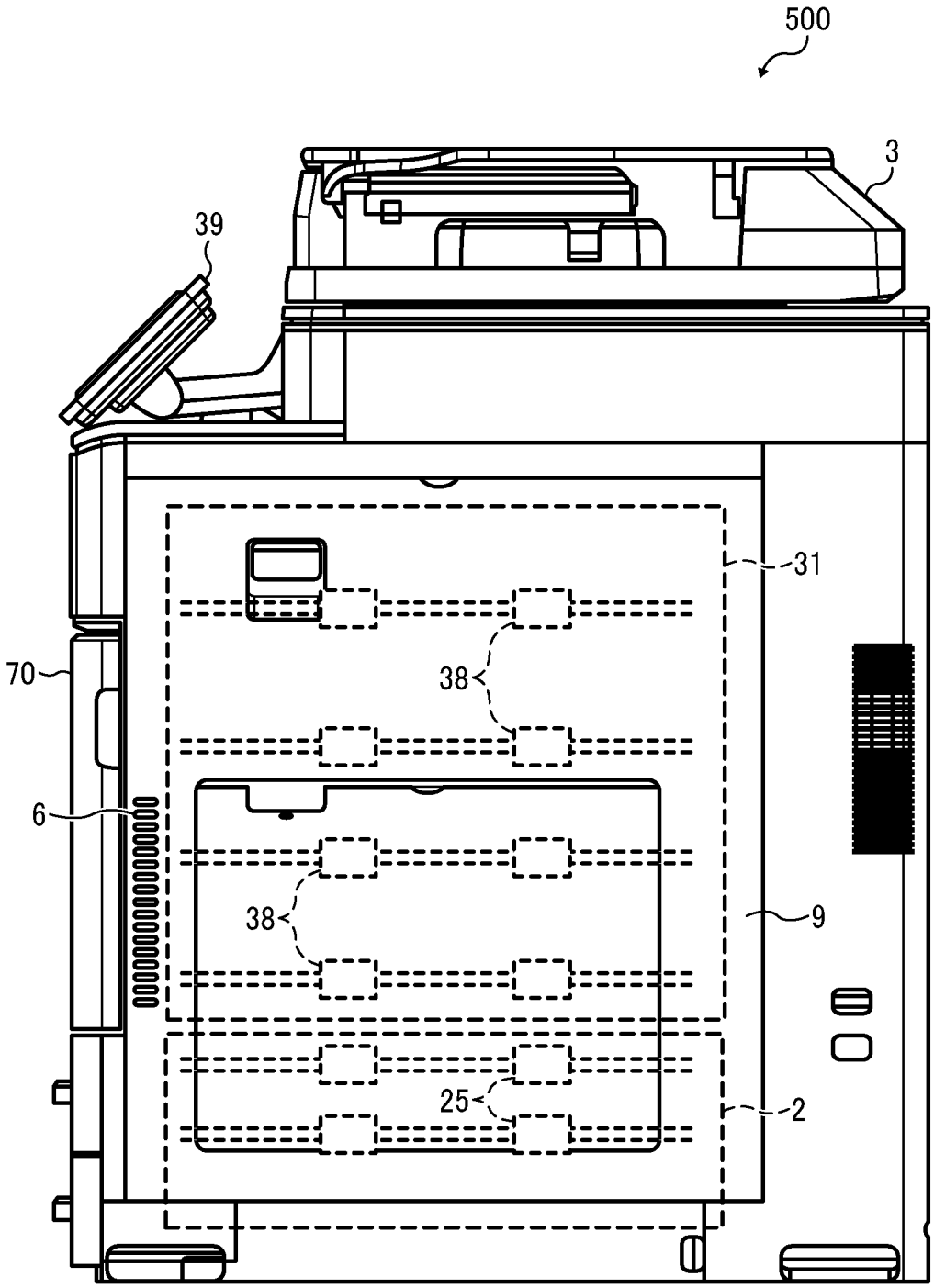
FIG. 5 is a side view of the image forming apparatus as viewed from the right in FIG. 3.

FIG. 5 is a side view of the image forming apparatus 500 as viewed from the right in FIG. 3.

As illustrated in FIG. 5, a sheet conveyance section, which includes the conveyance rollers 38 of the sheet reversal unit 31 and the conveyance rollers 25 of the sheet feeder 2, is positioned inside the right-side cover 9. The right-side cover 9 is an openable and closable cover to contain the sheet conveyance section to transports the transfer sheets P by these rollers.

The sheet conveyance section is a sound source of movement for sheet conveyance. It is possible that the sound generated at that time passes through a clearance between the right-side cover 9 and an interior cover 40 illustrated in FIG. 6, which is described in detail later, and leaks from the side cover openings 6 to the outside.

Another example of the sound sources of the sound leaking from the side cover openings 6 is described below.

Figure 6:
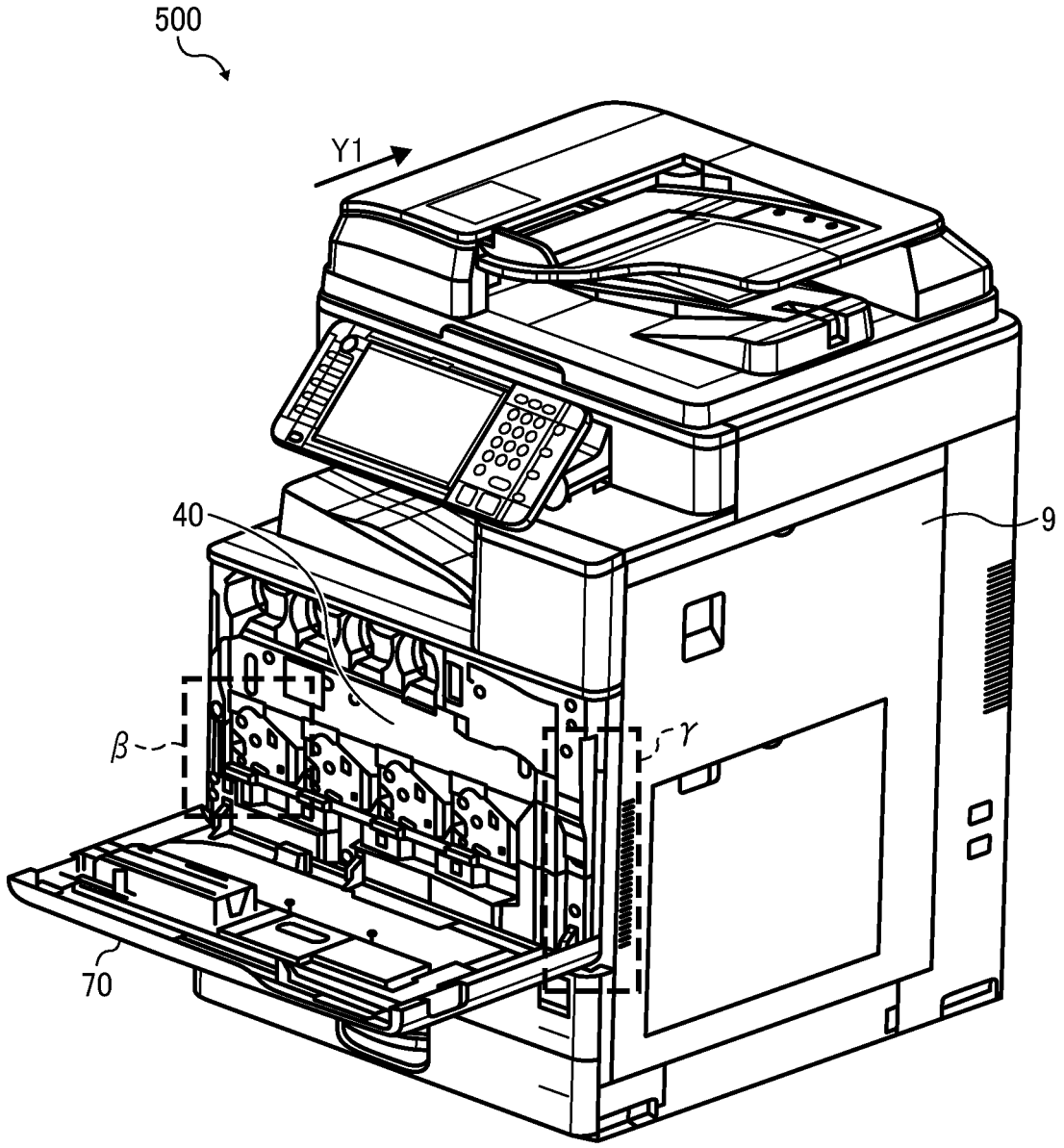
FIG. 6 is a perspective view that illustrates the image forming apparatus in a state in which the front cover is open.
Figure 7:
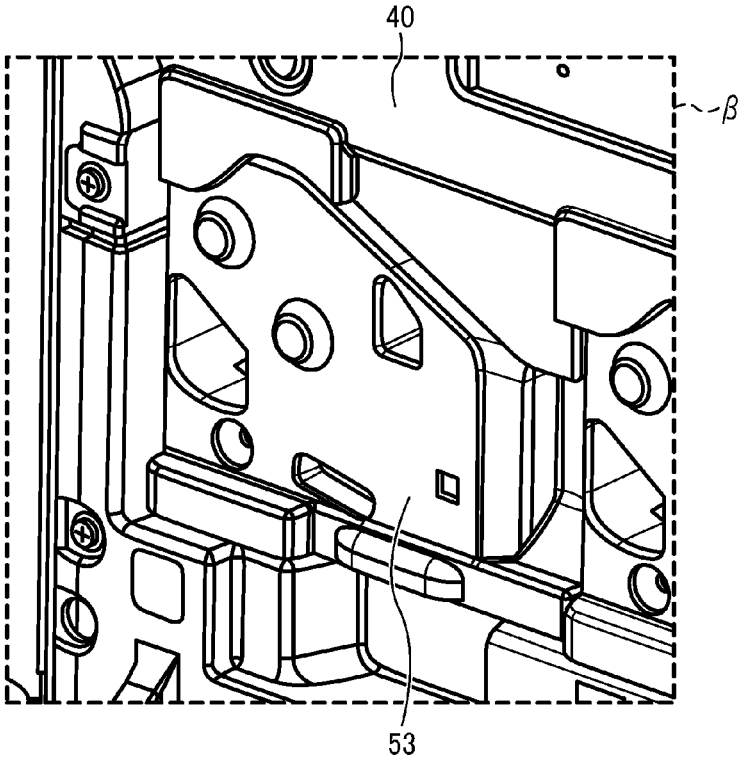
FIG. 7 is an enlarged perspective view of an area of the image forming apparatus illustrated in FIG. 6.
Figure 8:
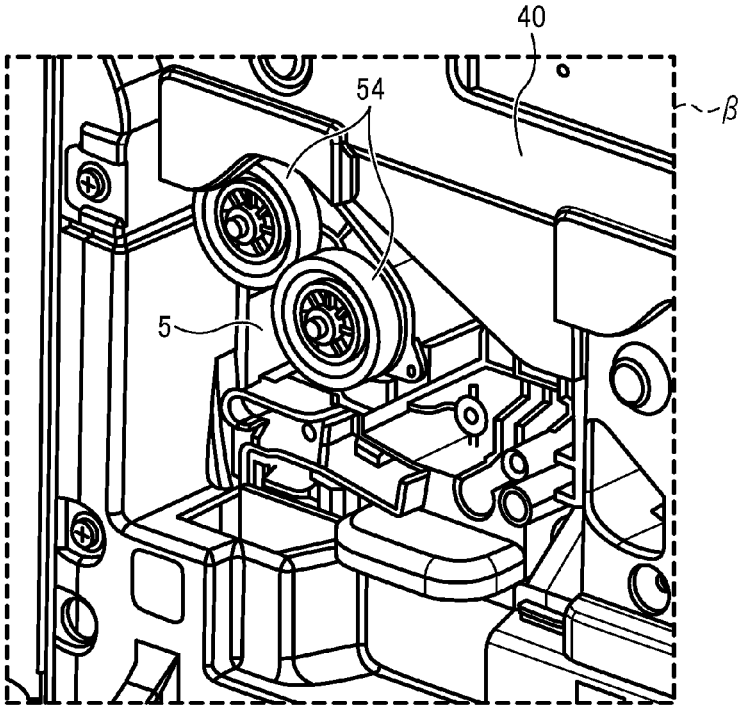
FIG. 8 is an enlarged partial view of the image forming apparatus, in a state in which an image forming unit cover is removed from the state illustrated in FIG. 7.
Figure 9:
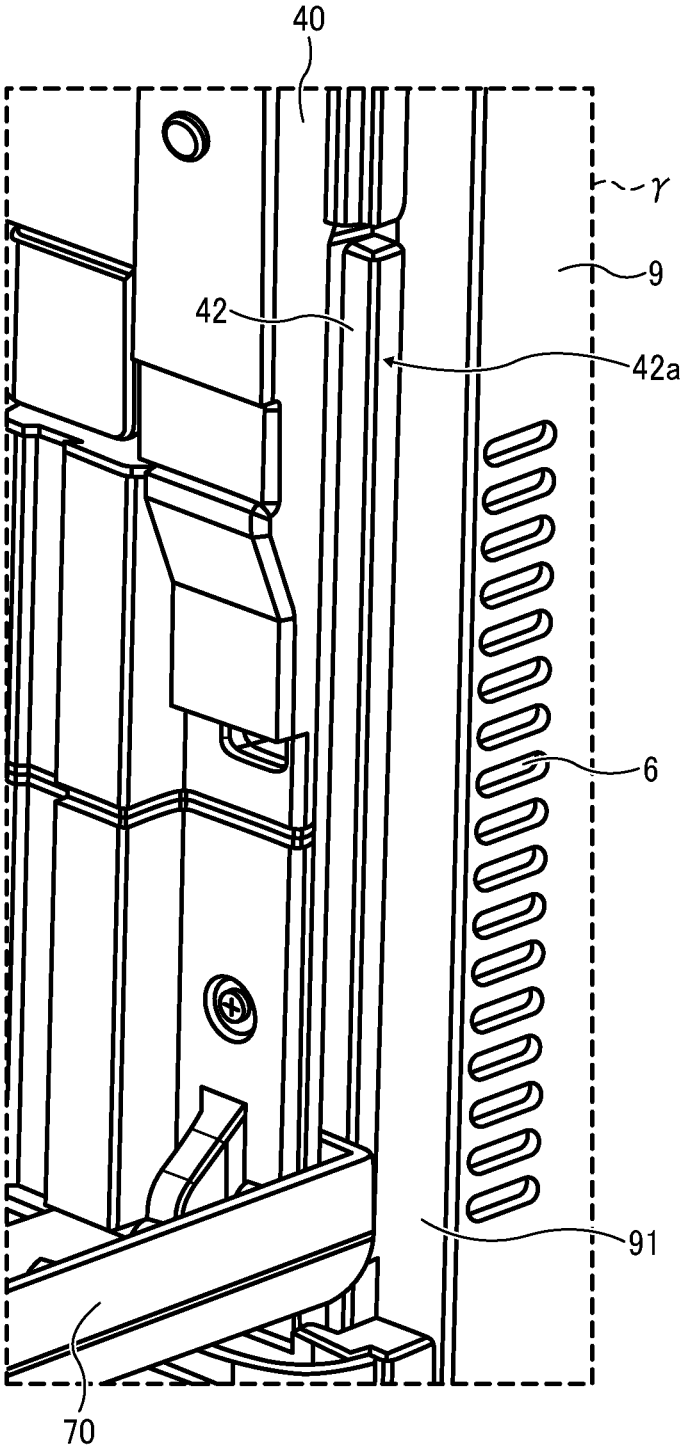
FIG. 9 is an enlarged perspective view of an area of the image forming apparatus illustrated in FIG. 6.

FIG. 6 is a perspective view that illustrates the image forming apparatus 500 in the state in which the front cover 70 is open. FIG. 7 is an enlarged perspective view of an area β in FIG. 6. FIG. 8 is an enlarged perspective view of the area β in FIG. 6, in a state in which an image forming unit cover 53 is removed from the state illustrated in FIG. 7. FIG. 9 is an enlarged perspective view of an area γ in FIG. 6.

In the present embodiment, the four image forming stations 5 are removable from the image forming apparatus 500. That is, four insertion openings are disposed (in the interior cover 40) on the front side of the image forming apparatus 500, and the four image forming stations 5 are inserted into the image forming apparatus 500 to the rear side in the direction indicated by arrow Y1 in FIG. 6. Additionally, the image forming apparatus 500 includes the image forming unit cover 53 so that the image forming stations 5 are not exposed when the front cover 70 is open. To remove the image forming stations 5 from the image forming apparatus 500 for replacement work or the like, the front cover 70 is opened, the image forming unit cover 53 is removed, and the image forming stations 5 are pulled out.

As illustrated in FIG. 8, driving gears 54 to drive the developing device are disposed on the front side of the image forming station 5 (identical to the front side of the image forming apparatus 500). The driving gears 54 are sound sources relating to the driving of the developing device, and it is possible that the sound generated at that time passes through a clearance between the front cover 70 and the interior cover 40 and leaks from the side cover openings 6 to the outside.

FIG. 1 is an enlarged horizontal cross-sectional view of a boundary between the front cover 70 and the right-side cover 9 of the image forming apparatus 500, as viewed from above. Specifically, FIG. 1 is a horizontal cross-sectional view along line A-A in FIG. 4 and illustrates an adjacent area of the side cover openings 6 in the image forming apparatus 500.

Figure 10:
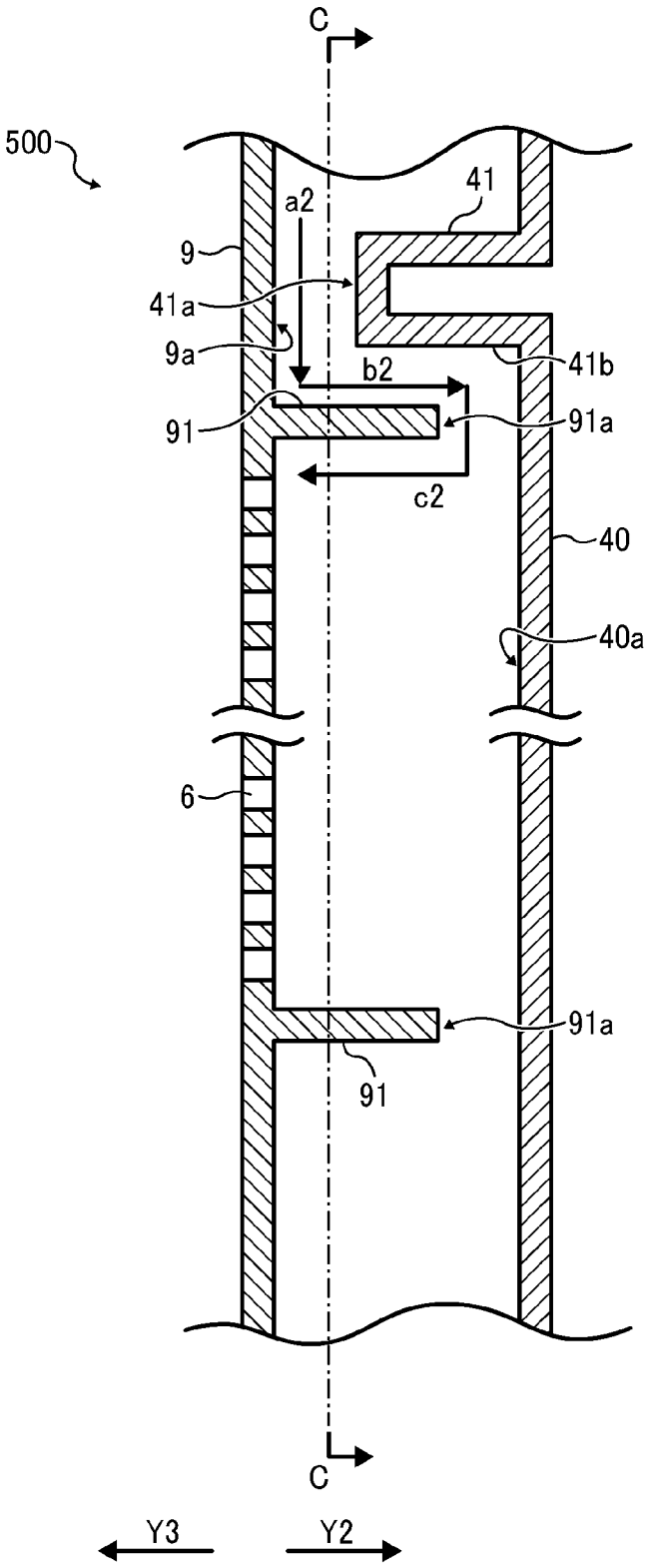
FIG. 10 is a vertical cross-sectional view along line B-B in FIG. 4 and illustrates a portion adjacent to side cover openings according to an embodiment.
Figure 11:
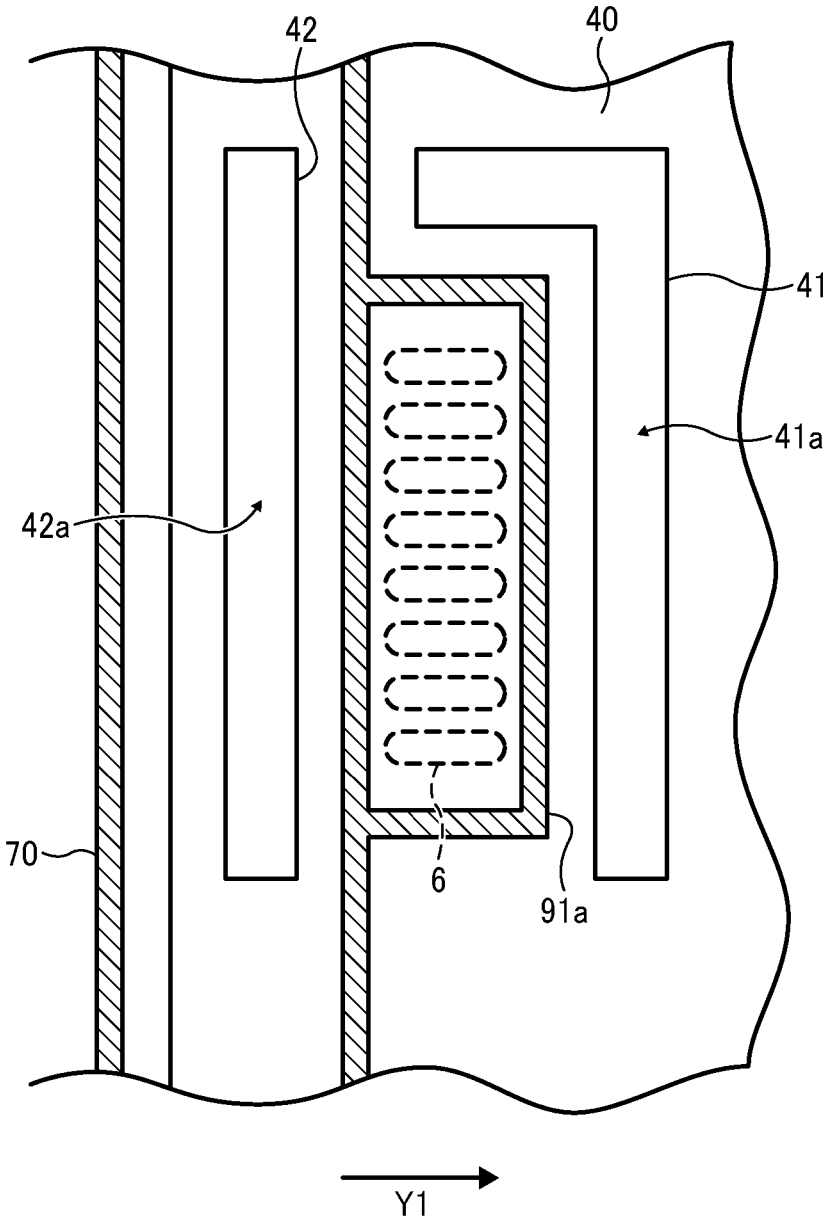
FIG. 11 is a vertical cross-sectional view of the image forming apparatus, along line C-C in FIGS. 1 and 10, as viewed from a side.

FIG. 10 is a vertical cross-sectional view along line B-B in FIG. 4 and illustrates the adjacent are of the side cover openings 6 in the image forming apparatus 500. FIG. 11 is a vertical cross-sectional view of the image forming apparatus 500, along line C-C in FIGS. 1 and 10, as viewed from a side. Although the side cover openings 6 are not visible in the cross section illustrated in FIG. 11, for ease of understanding, broken lines represent an opposing area of the side cover openings 6.

The image forming apparatus 500 includes a frame (i.e., framework) to support the devices used to form images. Such devices are screwed to the frame in a manner that the multiple exterior covers are removable for maintenance work or replacement of component parts. For example, the frame is made of metal such as iron, aluminum, and the like. However, the material of the frame is not limited to metal, and other materials can be used as long as stiffness thereof is sufficient to support the devices.

The interior cover 40 is disposed inside the right-side cover 9. That is, the interior cover 40 is disposed to face an inner face (hereinafter "right-side inner face 9*a*") of the right-side cover 9 as illustrated in FIG. 10. The interior cover 40 is secured to the frame. The right-side cover 9 includes exterior cover ribs 91 (i.e., inward projections) projecting inward from the right-side inner face 9*a* to the interior cover 40.

The interior cover 40 includes a projecting portion 41 projecting outward in the direction to the right-side cover 9 from an outer face (hereinafter "interior-cover outer face 40*a*"). The projecting portion 41 includes a flat end face 41*a*, which faces the right-side inner face 9*a*.

In the present embodiment, "inward and outward direction" refers to the direction parallel to the direction in which the interior cover 40 faces the right-side cover 9. That is, the inward and outward direction refers to the direction in which the exterior cover ribs 91 and the projecting portion 41 project (the vertical direction indicated by arrows Y2 and Y3 in FIG. 1). Further, "virtual plane" refers to a virtual vertical plane along line C-C (front to rear direction) and perpendicular to the inward and outward direction indicated by arrows Y2 and Y3. The vertical plane includes the lateral direction in FIG. 1 and the direction from the front to the back of the paper on which FIG. 1 is drawn.

Figure 12:
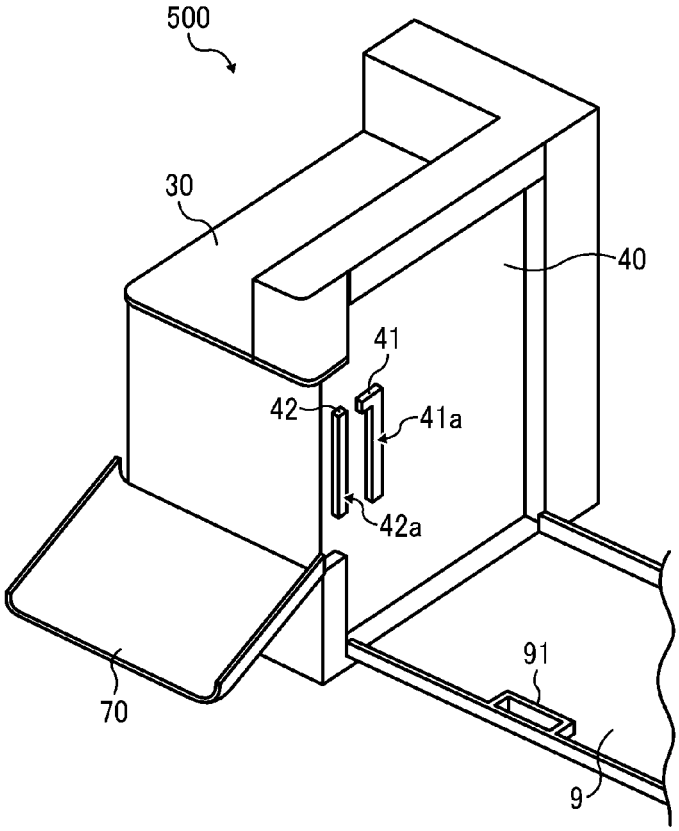
FIG. 12 is a schematic perspective view of the image forming apparatus in a state in which a scanner is removed and the front cover as well as the right-side cover is open.

Referring to FIGS. 11 and 12, the exterior cover ribs 91 has an enclosure part (rectangular in FIG. 11) that surrounds the side cover openings 6 on the virtual plane along line C-C. The projecting portion 41 is positioned on the rear (on the right in FIG. 11) of the enclosure part of the exterior cover rib 91 and extends in the vertical direction in FIG. 11. The projecting portion 41 extends also in the lateral direction in FIG. 11 on the upper side of the enclosure part of the exterior cover rib 91 in FIG. 11.

As illustrated in FIGS. 1 and 10, an end (a rib end face 91*a* in particular) of the exterior cover rib 91 is closer to the interior-cover outer face 40*a* of the interior cover 40 than the flat end face 41*a*, which is the end of the projecting portion 41. In other words, a distance between the rib end face 91*a* and the interior-cover outer face 40*a* is shorter than a distance between the flat end face 41*a* and the interior-cover outer face 40*a*. Further, referring to FIGS. 1, 10, and 11, a side face (perpendicular to the rib end face 91*a*) of the exterior cover rib 91 faces a side face 41*b* (in FIG. 1, perpendicular to the flat end face 41*a*) of the projecting portion 41 via a clearance in the direction along line C-C.

Referring to FIG. 1, the clearance between the right-side cover 9 and the interior cover 40 includes a projection adjacent area 80 where the exterior cover rib 91 faces the interior-cover outer face 40*a*, with a distance D3 secured therebetween, and the projecting portion 41 faces the right-side inner face 9*a*, with a distance D2 secured therebetween. The distance (D2 or D3) between the right-side cover 9 and the interior cover 40 in the projection adjacent area 80 is smaller than a distance D1 between the right-side inner face 9*a* of the right-side cover 9 and the interior-cover outer face 40*a* of the interior cover 40. As indicated by arrows a, b, and c in FIG. 1, the airflow passage leading from the rear side (right side in FIG. 1) of the projection adjacent area 80 to the side cover openings 6 has a labyrinth structure including multiple bent portions (including bent portions 81*a* and 81*b*). In other words, for the air flowing from the rear side of the apparatus to the side cover openings 6 (hereinafter "airflow direction"), the labyrinth airflow passage is defined by the right-side cover 9 and the interior cover 40 including faces perpendicular or oblique to the airflow direction.

More specifically, in the clearance (airflow passage) between the right-side cover 9 and the interior cover 40, air flows along the interior-cover outer face 40*a* of the interior cover 40 from the rear side of the apparatus to the side cover openings 6. Initially, a part of the air flowing from the rear side (in a forward direction indicated by arrow Y4) of the projecting portion 41 is blocked by a rear face 41C of the projecting portion 41. Then, the airflow passage is bent to the direction in which the projecting portion 41 projects, toward the outside of the apparatus (downward in FIG. 1) as indicated by arrow Y3 (hereinafter "outward direction Y3"). The air oriented in the direction in which the projecting portion 41 projects is then blocked by the right-side inner face 9*a* of the right-side cover 9, and the airflow direction is bent from the outward direction Y3 to the direction along the right-side inner face 9*a* (or the above-described virtual plane). In addition to the airflow thus bent, the air flowing along the right-side inner face 9*a* in the forward direction Y4 to the side cover openings 6 flows through the clearance between the right-side inner face 9*a* and the flat end face 41*a* of the projecting portion 41 in the projection adjacent area 80, as indicated by arrow a in FIG. 1.

Subsequently, the air is blocked by a rear face of the exterior cover rib 91 and bent from the forward direction Y4 to the direction in which the exterior cover rib 91 projects (inward direction indicated by arrows Y2). As indicated by arrow b in FIG. 1, the air passes through the clearance between the side face 41*b* (on the left) of the projecting portion 41 and the rear face of the exterior cover rib 91. Subsequently, the air is blocked by the interior-cover outer face 40*a* downstream from the rib end face 91*a* in the projecting direction of the exterior cover rib 91, and the airflow direction is bent from the inward direction Y2 to the forward direction Y4 (the virtual plane) along the interior-cover outer face 40*a*. As indicated by arrow c, the air passes through the clearance between the interior-cover outer face 40*a* and the rib end face 91*a* and reaches the side cover openings 6.

With this configuration, while the sound generated inside the image forming apparatus 500 travels through the projection adjacent area 80 to the outside, the sound is inevitably diffracted multiple times. Sound attenuates each time the sound is diffracted. Accordingly, leak of sound is inhibited by diffracting multiple times the sound traveling from inside the image forming apparatus 500 to the outside.

The size of the clearance between the right-side cover 9 and the interior cover 40, which defines the route indicated by arrows a, b, and c in the projection adjacent area 80, is about 3 mm in the present embodiment. The size of the clearance, however, is not limited thereto.

The labyrinth structure of the projection adjacent area 80 suppresses leak of the sound from the sheet conveyance section, in which the components, such as the conveyance rollers 38 and the conveyance rollers 25 disposed inside the right-side cover 9, move to transports sheets. Among various types of sound generated inside the image forming apparatus 500, the sound arising from sheet conveyance is likely to be perceived as noise. Therefore, to suppress the sound arising from sheet conveyance, the route passing through the projection adjacent area 80 has the labyrinth structure.

Specifically, out of the sound traveling in the direction indicated by arrow a in FIG. 1, the sound diffracted at the bent portion 81*a* (serving as a first diffract opening), where the right-side inner face 9*a* in the projection adjacent area 80 faces a front end of the flat end face 41*a*, travels as indicated by arrow b.

Out of the sound traveling in the direction indicated by arrow b, the sound diffracted at the bent portion 81*b* (serving as a second diffract opening), where the rib end face 91*a* of the exterior cover rib 91 in the projection adjacent area 80 faces the side face 41*b*, travels as indicated by arrow c. Then, the sound exits the image forming apparatus 500 through the side cover openings 6 in the right-side cover 9.

Additionally, in the direction (forward indicated Y4) in which the sound travels, a width W1 of the flat end face 41*a* of the projecting portion 41 is sufficiently wider than a width W3 of the rib end face 91*a* opposed to the interior-cover outer face 40*a*. In other words, the projecting portion 41 is greater in width than the exterior cover rib 91 in an airflow direction (indicated by arrow Y4) toward the side cover openings 6, and the airflow direction is perpendicular to the direction in which the interior cover 40 faces the right-side cover 9. For example, the width W3 of the rib end face 91*a* is about 1 mm to 2 mm, and the width W1 of the flat end face 41*a* is about 10 mm.

The sound traveling in the direction indicated by arrow a in FIG. 1 passes through the projection adjacent area 80 positioned between the right-side inner face 9*a* and the flat end face 41*a*. At that time, attenuation of sound is promoted since the distance in the direction in which the sound travels is long owing to the wide flat end face 41*a*. In addition to the above-described diffraction of sound, this configuration contributes to reduction in the sound that exits the image forming apparatus 500 from the side cover openings 6 in the right-side cover 9.

In the present embodiment, the opposed face of the projecting portion 41 opposed to the right-side inner face 9*a* is flat (i.e., the flat end face 41*a*). However, the shape of the opposed face is not limited thereto as long as the opposed face secures a longer distance than the distance attained by a typical rib in the direction in which the sound travels. The flat opposed face is advantageous in suppressing the sound leaking from the side cover openings 6 without sacrificing the design or appearance of the interior cover 40.

For example, the width W3 is attained by disposing, inside the right-side cover 9, the exterior cover rib 91 having a width identical to a thickness of the right-side cover 9. By contrast, the projecting portion 41 is formed by folding back the interior cover 40, which is planar and identical in thickness to the right-side cover 9, such that an interior of the projecting portion 41 is hollow. That is, the projecting portion 41 is a hollow projection.

Being shaped like a folded plate, the projecting portion 41 can include the flat end face 41*a* having the width W1 sufficiently longer than the thickness (1 mm to 2 mm) of the interior cover 40. For example, the interior cover 40 is made of resin.

In a case of a rib shaped like a single plate projecting from the interior cover 40, a sufficient distance is not secured for sound attenuation in the clearance between the end face of the rib and the inner face of the exterior cover (e.g., the right-side cover 9). By contrast, in the present embodiment, by making the width W1 of the projecting portion 41 longer, sound attenuation is promoted in the clearance between the flat end face 41*a* and the right-side inner face 9*a*.

Compared with providing a simple rib, the flat end face 41*a* wider than the width W3 of the exterior cover rib 91 is advantageous in improving the appearance and strength of the projecting portion 41 (i.e., outward projection) projecting from the interior-cover outer face 40*a*, which is exposed when the right-side cover 9 is open.

FIG. 12 is a schematic perspective view of the image forming apparatus 500 in the state in which the scanner 3 is removed and the front cover 70 as well as the right-side cover 9 is open. FIG. 12 illustrates relative positions of the projecting portion 41 and a front projecting portion 42 on the interior cover 40 and the exterior cover rib 91 on the right-side cover 9.

The description above concerns the projection adjacent area 80 defined by the projecting portion 41 projecting from the interior cover 40, at the rear of the side cover openings 6 (on the right in FIG. 1). In the image forming apparatus 500 according to the present embodiment, as illustrated in FIG. 1, the front projecting portion 42 is disposed on the front side (on the left in FIG. 1) of the side cover openings 6. The front projecting portion 42 is similar in shape to the projecting portion 41. The front cover 70 includes a projecting part 70*c*, which is a projecting portion at the right end (lower side in FIG. 1). The projecting portion 42 includes an end face 42*a* positioned facing an inner face of the projecting part 70*c*. With this configuration, similar to the projection adjacent area 80, a labyrinth structure having multiple bent portions (i.e., detours) is defined between the projecting part 70*c* and the interior cover 40.

The labyrinth like clearance between the projecting part 70*c* and the interior cover 40 suppresses the sound, such as the sound of the driving gears 54 moving, that travels through the clearance between the front side (on the left in FIG. 1) of the interior cover 40 and the inner face of the front cover 70 toward the side cover openings 6.

Out of the sound traveling in the direction indicated by arrow a1 in FIG. 1, the sound diffracted at the position where a rear end (right end in FIG. 1) of the end face 42*a* faces the inner face of the projecting part 70*c*, travels as indicated by arrow b1. Further, out of the sound traveling in the direction indicated by arrow b1, the sound diffracted at the position where the projecting end (i.e., the rib end face 91*a*) of the exterior cover rib 91 faces a side face 42*b* of the front projecting portion 42, travels as indicated by arrow c1. Then, the sound exits the image forming apparatus 500 through the side cover openings 6 in the right-side cover 9.

Additionally, in the direction in which the sound travels (backward direction Y1), a width W2 of the end face 42*a* of the front projecting portion 42 is sufficiently wider than the width W3 of the rib end face 91*a*. For example, the width W2 of the front projecting portion 42 is about 10 mm.

With this configuration, similar to the projection adjacent area 80 defined by the projecting portion 41, the clearance defined by the front projecting portion 42 attenuates the sound leaking from the image forming apparatus 500.

As illustrated in FIG. 10, the projecting portion 41 and the exterior cover rib 91 together define a labyrinth structure also on the upper side of the side cover openings 6. Accordingly, as indicated by arrows a2, b2, and c2 in FIG. 10, the sound traveling toward the side cover openings 6 is diffracted multiple times and thus attenuated. Thus, leak of the sound is suppressed.

As illustrated in FIGS. 10 and 11, neither the projecting portion 41 nor the front projecting portion 42 is provided below the side cover openings 6. For the sound generated by the sheet conveyance section to go down, the sound inevitably goes around the lower side of the projecting portion 41 and thus is diffracted multiple times. Similarly, for the sound generated by the driving gears 54 to go down, the sound inevitably goes around the lower side of the front projecting portion 42 and thus is diffracted multiple times. Accordingly, the sound attenuates, and leak of the sound from the side cover openings 6 is suppressed.

Figure 13:
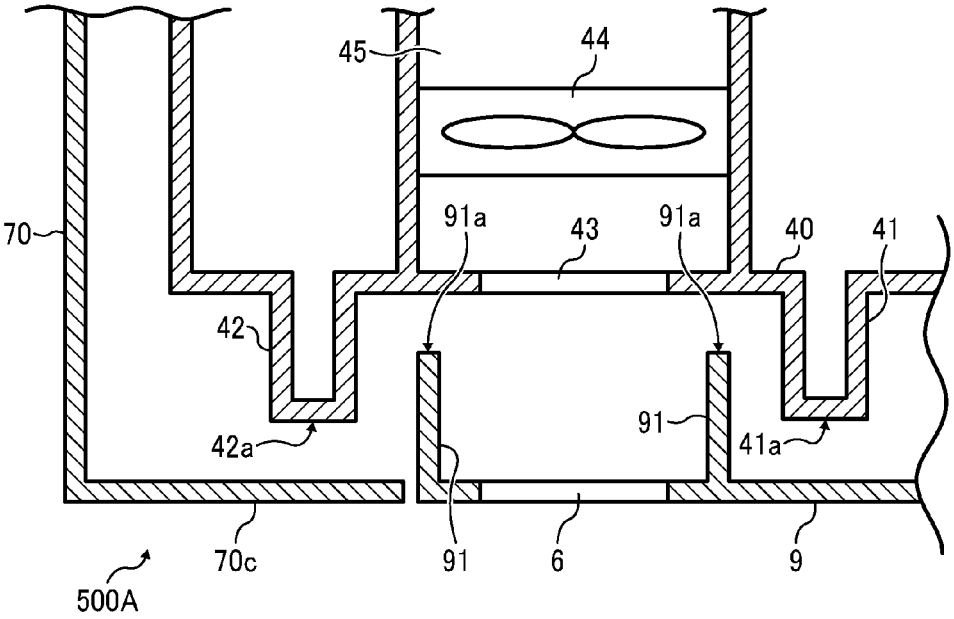
FIG. 13 is a horizontal cross-sectional view, along line A-A in FIG. 4, of an image forming apparatus according to another embodiment, including an interior cover opening.
Figure 14:
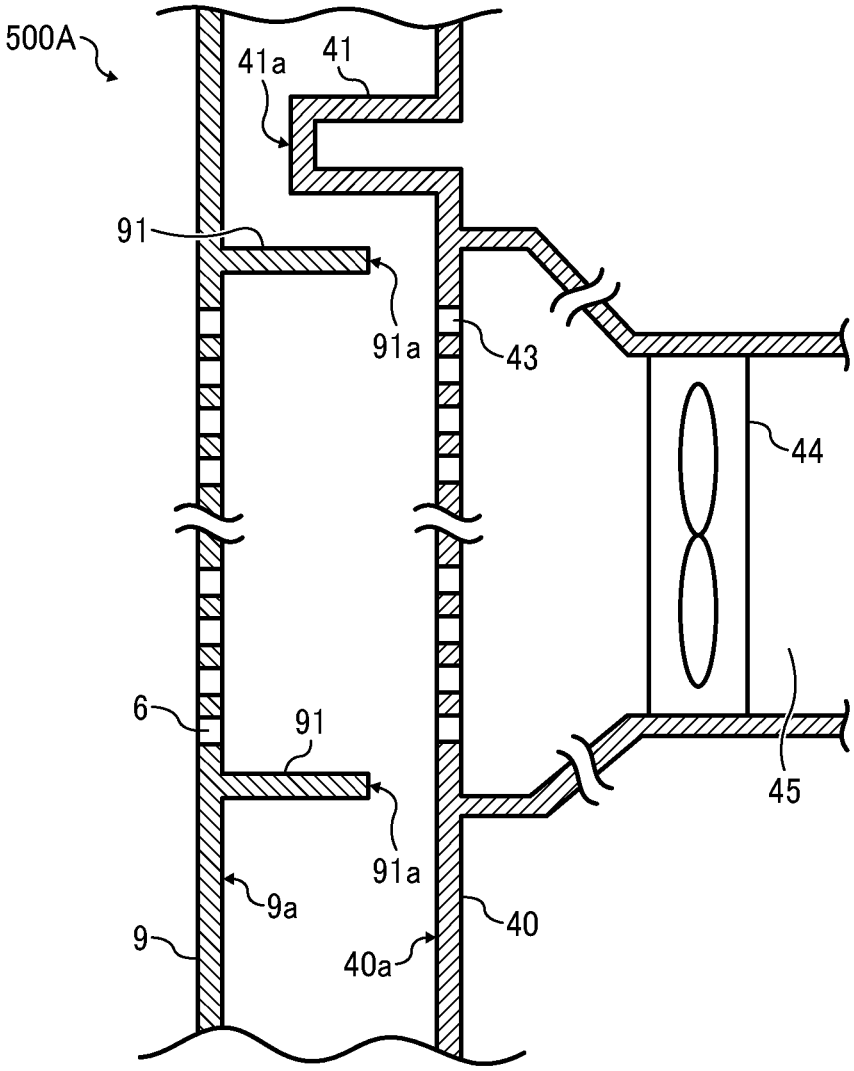
FIG. 14 is a vertical cross-sectional view of the image forming apparatus illustrated in FIG. 13, along line B-B in FIG. 4.

FIG. 13 is a horizontal cross-sectional view of an image forming apparatus 500A including an interior cover opening 43 through which the interior of the interior cover 40 communicates with outside of the interior cover 40. FIG. 13 illustrates the cross section along line A-A in FIG. 4. FIG. 14 is a vertical cross-sectional view of the image forming apparatus 500A and corresponds to the cross section along line B-B in FIG. 4.

In FIGS. 13 and 14, reference numeral 45 represents an inner space inside the interior cover 40 of the image forming apparatus 500A. The image forming apparatus 500A illustrated in FIGS. 13 and 14 includes the interior cover opening 43 formed in the interior cover 40, at a position opposed to the side cover openings 6 in the interior cover 40.

This configuration allows the inner space 45 to communicate with the outside of the image forming apparatus 500A, thus facilitating exchange of air inside the image forming apparatus 500A with external air. Then, the external air can inhibit temperature rise inside the image forming apparatus 500A.

For efficient ventilation, it is preferred that the side cover openings 6 and the interior cover opening 43 are larger in area. Simply increasing the area of the side cover openings 6, however, results in increases in the sound that travels through the clearance between the interior cover 40 and the exterior cover (the front cover 70 and the right-side cover 9) and leaks from the side cover openings 6. Although the leak of sound is inhibited by reducing the area of the side cover openings 6, it is not convenient for ventilation efficiency. Therefore, in the image forming apparatuses 500 and 500A according to the embodiments, the leak of sound can be inhibited by the labyrinth structure provided in the clearance between the interior cover 40 and the exterior cover without reducing the area of the side cover openings 6. This configuration attains inhibition of temperature rise and suppression of leak of sound.

Additionally, in another embodiment, as illustrated in FIGS. 13 and 14, a fan 44 (i.e., an air blower) is disposed inside the interior cover opening 43 of the interior cover 40 to facilitate exchange of the internal air with the external air. In the arrangement illustrated in FIG. 13, the fan 44 is disposed facing the interior cover opening 43. The fan 44 facilitates inhibition of temperature rise inside the image forming apparatus 500A. The fan 44 can be a suction fan to suck in the external air (i.e., cool air) through the side cover openings 6 and the interior cover opening 43. Alternatively, the fan 44 can an exhaust fan to exhaust heated internal air from inside the image forming apparatus 500A through the side cover openings 6 and the interior cover opening 43.

Among image forming apparatuses including the exterior cover and the inner cover (i.e., a double cover structure) such as the image forming apparatus 500A, in an image forming apparatus known to the inventors, a communicating opening to communicate with each of the exterior cover and the inner cover is provided to introduce external air into the apparatus and to exhaust heat from the apparatus, thereby inhibiting temperature rise inside the apparatus.

In a double cover structure in which the exterior cover is openable, the outer face of the inner cover is exposed to eyes of users when the exterior cover is opened. At that time, if planar ribs similar in thickness to the cover stand on the flat outer face of the inner cover, the appearance is not good. Additionally, a rib formed by a single plate is not sufficient in strength, and there is a risk of damage thereto by external force. For example, there is a risk that users or maintenance workers touch the planar rib projecting from the outer face of the inner cover when the inner cover is exposed for replacement of consumables or maintenance work.

By contrast, the image forming apparatus 500A illustrated in FIGS. 13 and 14 includes the projecting portion 41 projecting from the interior-cover outer face 40*a* of the interior cover 40 of the double cover structure, and the projecting portion 41 includes the flat end face 41*a* sufficiently wider than the thickness of the interior cover 40. By defining the labyrinth structure with the flat end face 41*a* and the exterior cover rib 91, the sound leaking from the opening (e.g., the side cover openings 6) in the exterior cover (e.g., the right-side cover 9) is suppressed without sacrificing the design, appearance, and strength of the interior cover 40 when the exterior cover is opened.

Although, the housing of the image forming apparatus is described above as the embodiments, aspects of the present disclosure are not limited thereto but adapt to other electronic apparatuses including a device that generates sound (i.e., a sound source) when the electronic apparatus operates and a sound absorption device to absorb the sound.

Further, the aspects of the present disclosure, such as the above-described clearance, are not limited to housing structures of electronic apparatuses but adapt to other housing structures to suppress the sound leaking from inside the housing structure.

The configurations described above are just examples, and each of the following aspects of this specification attains a specific effect.

[Aspect A]

A housing structure, such as the right-side cover 9 and the interior cover 40 of the image forming apparatus 500, includes an exterior cover, such as the right-side cover 9, having an opening, such as the side cover openings 6, through which an interior of the exterior cover communicates with outside of the exterior cover; an interior cover, such as the interior cover 40, having an outer face, such as the interior-cover outer face 40*a*, disposed inside the exterior cover and facing the exterior cover with a clearance secured therebetween; an inward projection, such as the exterior cover rib 91, projecting from the exterior cover to the interior cover; and an outward projection, such as the projecting portion 41, projecting from the interior cover to the exterior cover; and an airflow passage, such as the projection adjacent area 80, defined in the clearance to lead to the opening.

The airflow passage includes multiple detours defined by the inward projection and the outward projection. In this housing structure, the outward projection has a width (such as the width W1 in the direction perpendicular to the direction in which the outward projection projects) wider than a width (such as the width W3 of the rib end face 91*a*) of the inward projection.

According to this aspect, as described above, since the width of the outward projection is wider than the width of the inward projection, the outward projection is increased in strength compared with a configuration in which the outward projection is similar in width to the inward projection. With the housing structure that defines the airflow passage including multiple detours with the inward projection and the outward projection, damage to the outward projection is inhibited.

It is to be noted that, the term "detour" used here means a curve or a bent portion in a route that can be straight, and the detour transmits sound indirectly compared with a straight sound transmission route. Although, in the above-described embodiments, the airflow passage includes the multiple bent portions bent at right angle or substantially right angle, alternatively, the airflow passage may include multiple curves such that the direction of the airflow passage changes in a curved manner.

[Aspect B]

In Aspect A, the outward projection, such as the projecting portion 41, includes a flat end face.

This aspect is advantageous in suppressing the sound leaking from the opening in the exterior cover such as the side cover openings 6, as described above, without degrading the appearance or design of the interior cover such as the interior cover 40.

[Aspect C]

In Aspect A or B, the interior cover such as the interior cover 40 includes a communicating opening such as the interior cover opening 43, and the communicating opening is opposed to the opening such as the side cover openings 6.

As described above, this aspect is advantageous in inhibiting temperature rise inside the housing structure such as the right-side cover 9 and the right-side cover 9 of the image forming apparatus 500.

[Aspect D]

In Aspect C, inside the interior cover such as the interior cover 40, an air blower such as the fan 44 is disposed to generate airflow such that the airflow passes through the opening such as the side cover openings 6 and the communicating opening such as the interior cover opening 43. For example, the air blower (the fan 44) is disposed inside the communicating opening (the interior cover opening 43) as illustrated in FIGS. 13 and 14 to direct the airflow to the communicating opening and further to the opening (the side cover openings 6) in the exterior cover (the right-side cover 9).

As described above, this aspect is advantageous in facilitating inhibition of temperature rise inside the housing structure such as the right-side cover 9 and the right-side cover 9 of the image forming apparatus 500.

[Aspect E]

In any one of Aspects A through D, the exterior cover such as the right-side cover 9 is openably closable relative to the interior cover such as the interior cover 40.

According to this aspect, as described above, even when the exterior cover is openable and closable, damage to the outward projection is inhibited in the housing structure that defines the airflow passage including multiple detours with the inward projection and the outward projection.

[Aspect F]

In an electronic apparatus, such as the image forming apparatuses 500 and 500A, that includes a sound source, such as the sheet conveyance section and the developing device, and a housing, such as the front cover 70 and the right-side cover 9, to cover the sound source, the housing structure according to any one of Aspects A through E is used.

With this aspect, as described above, while inhibiting temperature rise inside the electronic apparatus when the electronic apparatus operates, leak to the outside of sound generated by the operation of the electronic apparatus is inhibited. Additionally, this aspect is advantageous in inhibiting damage to the outward projection, such as the projecting portion 41, of the interior cover, such as the interior cover 40.

[Aspect G]

An electrophotographic image forming apparatus such as the image forming apparatus 500 includes the configuration of the electronic apparatus according to Aspect F.

With this aspect, as described above, while inhibiting temperature rise inside the apparatus during image formation, leak to the outside of sound generated during image formation is inhibited. Additionally, this aspect is advantageous in inhibiting damage to the outward projection, such as the projecting portion 41, of the interior cover, such as the interior cover 40.

Numerous additional modifications and variations are possible in light of the above teachings. It is therefore to be understood that, within the scope of the appended claims, the disclosure of this patent specification may be practiced otherwise than as specifically described herein.

What is claimed is:

1. A housing structure comprising:

an exterior cover having an opening through which an interior of the exterior cover communicates with an exterior of the exterior cover;

an interior cover disposed inside the exterior cover and having an exterior facing the exterior cover with a clearance secured therebetween;

an inward projection projecting from the exterior cover to the interior cover; and an outward projection projecting from the interior cover to the exterior cover;

wherein the inward projection and the outward projection define an airflow passage in the clearance between the exterior cover and the interior cover, the airflow passage leading to the opening and including multiple bent portions, and an end face of the outward projection closest to the interior of the exterior cover has a width greater than a width of an end face of the inward projection closest to the exterior of the interior cover.

2. The housing structure according to claim 1, wherein the end face of the outward projection is flat and is disposed facing the exterior cover.

3. The housing structure according to claim 2, wherein a distance between the end face of the inward projection and an outer face of the interior cover is shorter than a distance between the flat end face of the outward projection and the outer face of the interior-cover.

4. The housing structure according to claim 1, wherein the outward projection is a hollow projection.

5. The housing structure according to claim 1, wherein the interior cover includes a communicating opening positioned to face the opening in the exterior cover.

6. The housing structure according to claim 5, further comprising an air blower disposed inside the interior cover, the air blower disposed facing the communicating opening to generate airflow that passes through the communicating opening in the interior cover and the opening in the exterior cover.

7. The housing structure according to claim 1, wherein the exterior cover is openably closable relative to the interior cover.

8. An electronic apparatus comprising:

a sound source to generate sound; and the housing structure according to claim 1 to cover the sound source.

9. An electrophotographic image forming apparatus comprising:

a sound source to generate sound; and the housing structure according to claim 1 to cover the sound source.

10. The housing structure according to claim 1, wherein the width of the end face of the outward projection is longer than a thickness of a portion of the interior cover around the outward projection.

* * * * *